US005373680A

United States Patent [19]

Munsch

[11] Patent Number: 5,373,680

[45] Date of Patent: Dec. 20, 1994

[54] APPARATUS FOR FOLDING AND PACKAGING OF HYGIENE PRODUCTS SUCH AS TISSUES

[75] Inventor: Klaus Munsch, Neuwied, Germany

[73] Assignee: Winkler & Duennebier Maschinenfabrik und Eisengiesserei KG, Neuwied, Germany

[21] Appl. No.: 989,070

[22] Filed: Dec. 11, 1992

[30] Foreign Application Priority Data

Dec. 13, 1991 [DE] Germany ..... 4141143

[51] Int. Cl.[5] ..... B65B 63/04

[52] U.S. Cl. ..... 53/117; 53/168; 53/171; 53/206; 198/369

[58] Field of Search ..... 53/116, 117, 120, 171, 53/201, 206, 168; 198/358, 369, 447, 689.1

[56] References Cited

U.S. PATENT DOCUMENTS

| | | | |
|---|---|---|---|
| 1,987,211 | 1/1935 | Remington | 53/120 |
| 3,286,435 | 11/1966 | Weinberger | 53/117 |
| 3,500,611 | 3/1970 | Field | 53/120 |
| 3,647,044 | 3/1972 | Orstam | 198/447 X |
| 3,766,701 | 10/1973 | Besserdich et al. | 53/120 X |
| 4,084,391 | 4/1978 | Williams, Sr. et al. | 53/120 |
| 4,281,757 | 8/1981 | Morton | 198/358 |
| 4,284,187 | 8/1981 | Kramer et al. | 198/447 X |
| 4,499,988 | 2/1985 | Gasser | 198/369 |
| 4,555,013 | 11/1985 | Franklin | 198/689.1 |
| 4,874,076 | 10/1989 | Kaplan et al. | 198/358 X |
| 5,113,639 | 5/1992 | Bryson | 53/168 X |

*Primary Examiner*—John Sipos
*Assistant Examiner*—Daniel Moon
*Attorney, Agent, or Firm*—W. G. Fasse; W. F. Fasse

[57] ABSTRACT

An apparatus for folding and packaging of hygiene products such as tissues or sanitary napkins has two operational lines arranged in parallel between an input feeder and a packaging station. One of the lines includes stations for folding, enveloping, embossing, and cutting operations. The other line includes one or more transport mechanisms that by-pass the first mentioned line to transport articles directly from the inlet to a packaging station. Thus, if desired, articles may be supplied to the packaging station without any folding or other intermediate treatment by using the by-pass line. An output feeder is arranged to cooperate with either the main production line or the by-pass line for feeding articles to a packing station.

8 Claims, 2 Drawing Sheets

APPARATUS FOR FOLDING AND PACKAGING OF HYGIENE PRODUCTS SUCH AS TISSUES

FIELD OF THE INVENTION

The invention relates to an apparatus for folding and packaging of hygiene products such as tissues or sanitary napkins that are relatively long but have a small thickness.

BACKGROUND INFORMATION

Machines for folding such articles as mentioned above, have at least one folding station and if necessary, one or more further stations, including a packaging station. Such further stations include, for example, stations for producing individual packages which are then assembled into larger packets, whereby an individual package may comprise but a single sanitary napkin or the like. Any other article handling stations may be provided between the folding station and the final packing station.

Machines of the above type are well known in the art and basically work quite satisfactorily. In one conventional machine the individual articles are first folded once or several times if desired, whereupon individual articles are packaged, one to a package, whereupon the individually packaged articles are assembled in groups comprising any desired number of individual packages, for example, groups of six or twelve individual packages are assembled to form respective packets. However, known machines of this type leave room for improvement with regard to the versatility of these machines.

OBJECTS OF THE INVENTION

In view of the above it is the aim of the invention to achieve the following objects singly or in combination:

- to modify the above described apparatus in such a way that one and the same apparatus can be used for producing at least one further type of packaging in addition to the formation of six-packs and twelve-packs;
- to provide a packaging apparatus that is equally efficient in assembling flat tissue-type articles with a single fold or with multiple folds or having no fold at all;
- to assure that the individual articles are handled gently so that crumbling is avoided; and
- to construct the present apparatus in such a way that a switch over to any one of a plurality of different packaging operations is easily and quickly accomplished.

SUMMARY OF THE INVENTION

The apparatus according to the invention is characterized in that a by-pass transport section is provided in parallel to the folding station and in parallel to any intermediate stations between the folding station and the final packaging station in such a way that articles to be packaged can by-pass the folding station and any other intermediate station if desired, so as to reach the packaging station in an unfolded condition.

The by-pass transport section according to the invention makes it possible to transport the articles to be packaged selectively so that single folding, multiple folding, and no folding at all may be selected. Thus, groups of completely unfolded articles may be assembled for packaging if desired, while single folded and multiple folded articles may be assembled in groups comprising any desired number of articles. These features substantially improve the usefulness and efficiency of such an apparatus. Thus, it is now possible to use a single folding station apparatus or a double folding station apparatus that is equipped, if desired, with a single packaging device or with a multiple packaging device directly as a multiple packaging station if need be.

In a preferred embodiment of the invention the by-pass transport section is arranged at a level corresponding to the input level of the apparatus, whereby the articles are treated gently and in proper register with each other for the further transport because the articles to be packaged do not have to pass over steps in the transport direction.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
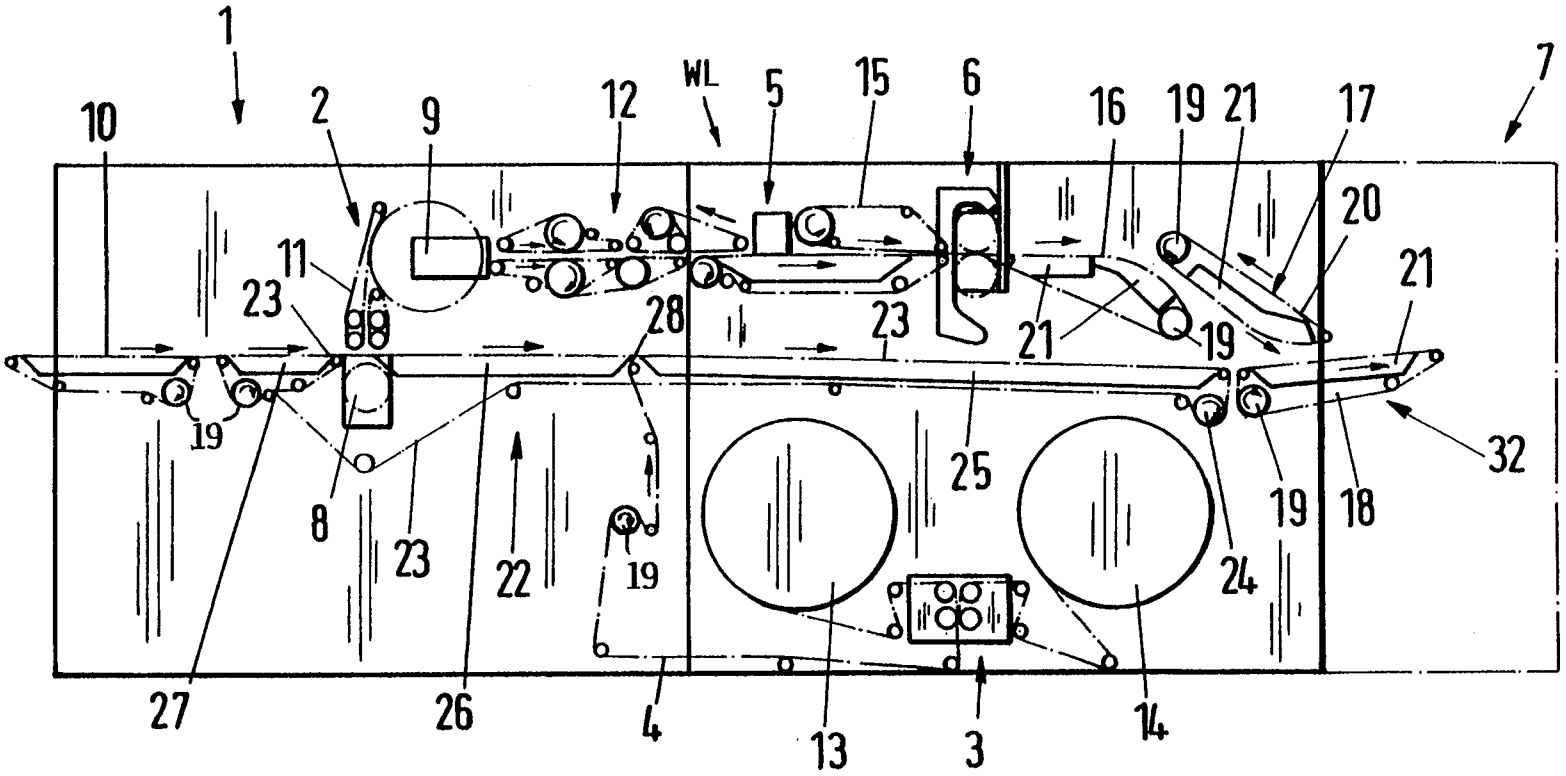
FIG. 1 shows a schematic side view of an apparatus according to the invention.

FIG. 1 shows the side view of an apparatus 1 for folding and packaging of hygiene articles. The apparatus comprises a work line WL, a by-pass line 22, and a folding station 2 having two sections 8 and 9. Section 8 forms a first folding device 8 as part of the by-pass line 22 and a second folding device 9 as part of the work line WL. The by-pass line 22 includes a single piece packaging station comprising in the shown example embodiment a roll off station 3 for supplying packaging film. The roll off station 3 is supplied by one film supply roller 13 or another film supply roller 14 so that an interruption of film supply is avoided. The work line WL includes the following stations or sections 2, 9, 12, 5, 6, 16, and 17 described in more detail below. An adhesive applicator and enveloping station is shown at 5. A crosswise embossing and cutting station is shown at 6, while a packaging station is shown at 7. Instead of the single piece packaging apparatus as just described, several article handling stations could be arranged downstream of the folding station 2 as viewed in the feed advance direction of the articles to be packaged.

As mentioned, the folding sections or station 2 comprises suitably two separate folding devices 8 and 9 so that articles supplied by an infeed transport belt 10 to the folding station 2 are folded once in the folding device 8, whereupon the once folded article is transported further with the aid of folding and transport belts 11, to the second folding device 9 for a double folding operation. Thus, articles passing only through folding device 8 are folded once and move along the by-pass line 22 to station 7 for packaging while articles passing along belts 11 and through folding device 9 are folded twice. A further transport device 12 in the work line WL conveys the double folded articles from the second folding device 9 to the adhesive applicator and enveloping station 5 in which articles are individually packaged. Such individual packaging takes place, for example, with the aid of the film 4 or any other suitable packaging material, such as paper supplied from the rollers 13 or 14 in the packaging material roll off station 3. The arrangement of two supply rollers 13 and 14 for the packaging material makes it possible to accomplish at least a semi-automatic or even a fully automatic change of the supply from one roller to the other in the roll-off station 3.

A transport mechanism 15 in the work line WL transports the individually packaged articles from the adhesive applicator and enveloping station 5 to the embossing and cutting station 6. A further transport mechanism 16, 17, and 18 transports the article to the packaging station 7 which is of conventional construction. The transport mechanisms 16, 17, and 18 comprise suction belts 20 driven by drive rollers 19 to run over suction boxes 21. These suction boxes are connected to a conventional suction pump not shown. The transport direction of the suction belts 20 in the transport mechanisms 16, 17, and 18 may be selected as desired, even in a falling direction, since the articles are held in place by suction as is shown by the suction boxes of the transport mechanisms 16 and 17, but so as to move articles toward the packaging station 7. The mechanism 18 has a slightly rising disposition in the transport direction from left to right in FIG. 1. More specifically, the transport mechanism 16 moves the articles coming from station 6 initially somewhat horizontally and then downwardly. On the downward stretch of the transport mechanism 16, the latter cooperates with the transport mechanism 17 which takes over the articles from the mechanism 16 and delivers the articles to the transport mechanism 18 that extends substantially horizontally or with a slight rise as mentioned.

FIG. 1 further shows a transport mechanism 22 that forms part of the above mentioned by-pass line 22 according to the invention. The by-pass transport 22 extends in parallel to the stations 2, 5, and 6 and below these stations of the work line WL as shown in FIG. 1 in such a way that articles to be packaged can by-pass the stations 2, 5, and 6 to be transported directly to the packaging station 7. The arrows indicate the travel direction.

The additional or by-pass transport mechanism 22 comprises at least one suction belt driven by drive roller 24 and cooperating with at least one suction box 25 connected to a conventional source of suction. According to the embodiment shown in FIG. 1, three suction boxes 25, 26, and 27 are provided to accommodate a single suction belt 23. The suction box 27 is suitably arranged upstream of the first folding device 8 of the folding station 2 and directly downstream of the infeed transport belt 10 as viewed in the travel direction of the articles from left to right. The second suction box 26, which is arranged downstream of the folding device 8, reaches to an intersection 28 through which film 4 travels for the enveloping of the individual articles. The third suction box 25 extends from the intersection 28 all the way to the output transport mechanism 18.

When the articles are to be directly transported on the by-pass transport belt 23 that extends all the way over all three suction boxes, it is not necessary to supply film 4 to the enveloping station 5. Therefore, at this time, the supply of film 4 is interrupted. On the other hand, when the by-pass 22 is not needed and film 4 is to be supplied to the station 5, the belt 23 may be removed or otherwise by-passed by the film 4.

Figure 2:
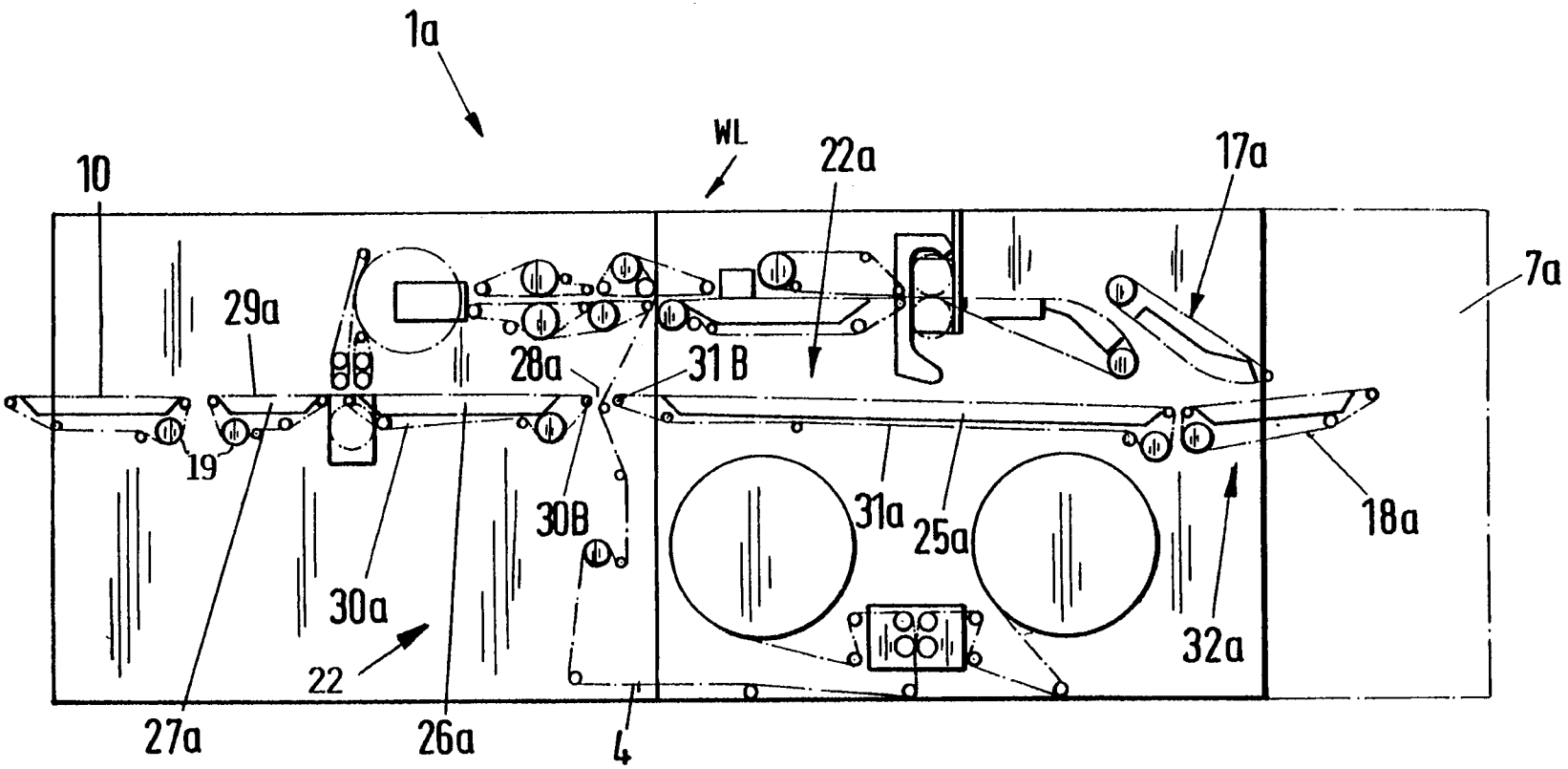
FIG. 2 shows a side view similar to that of FIG. 1, but illustrating a modified embodiment.

Further, when the by-pass 22 is in operation, a suction belt 29A, shown in FIG. 2, must bridge the gap between the infeed transport belt 10 and the suction box 26 to by-pass the folding device 8 of the folding station 2. Such a bridging transport belt 29A is removed or otherwise shifted out of the way when the by-pass is not used and the main line 9, 5, 6 is in operation.

FIG. 2 shows a modified embodiment of the invention, whereby the same components are provided with the same reference number, however, with the added index A. The apparatus 1A according to FIG. 2 comprises the same stations as in FIG. 1. However, in FIG. 2, the long suction belt 23 of the by-pass line 22 has been replaced by three shorter suction belts 29A, 30A, and 31A cooperating with the suction boxes 27A, 26A, and 25A respectively. By dividing the transport belt into three sections, the junction or intersection 28A is always free for the passage of the enveloping film 4. For this purpose, the suction belt 30A runs around a guide roller 30B directly next to the junction or crossing 28A. Similarly, the suction belt 31A runs around a guide roller 31B next to the crossing 28A. The suction box 27A cooperates with the suction belt 29A in FIG. 2 so that changes are not necessary when the by-pass is switched off and the main production line is switched on or vice versa. The conveyor or suction belt 29A with its box 27A is so constructed, that it can feed either into the main production line starting with the first folding device 8 or into the by-pass line 22A when the articles are transported without folding directly to the packaging station 7A over the conveyor 18A. In FIG. 2 the by-pass line 22 also extends below the work line WL.

In both embodiments shown in FIGS. 1 and 2, the transport mechanism 17 or 17A and the transport mechanism 22 or 31A transport the articles to the transport mechanism 18 or 18A. Therefore, the two transport mechanisms 18 and 17 together or 18A and 17A together perform in addition to the transporting function, a function of a collecting station or a collecting switch 32 or 32A. In other words, a single conveyor namely the conveyor 18 or 18A can receive articles either from the work line or main production line WL or from the by-pass line 22 depending on its angle of incline relative to the horizontal as seen in FIGS. 1 and 2.

Instead of using the described suction belts with their suction boxes, it is possible to use transport belts comprising upper and lower belts which cooperate with each other in the transport of the articles, or gripper mechanisms can be used for the transporting of the articles, whereby the grippers may be connected to transport belts or the like.

It has been found to be advantageous if the by-pass line is arranged in such a way that the articles transported on the by-pass line travel approximately in the same conveying plane as the articles on the infeed conveyors 10, 10A. This feature makes sure that the articles do not have to be lifted or lowered into another plane, whereby the articles are gently treated.

Although the invention has been described with reference to specific example embodiments it will be appreciated that it is intended to cover all modifications and equivalents within the scope of the appended claims.

What I claim is:

1. An apparatus for folding and packaging of hygiene articles, comprising an article inlet station and a packaging station for packing articles, a main production line, at least one folding station located along said main production line for folding articles, and a by-pass line for transporting non-folded articles, said apparatus further comprising a transport mechanism for selectively transporting articles through said main production line or through said by-pass line which is arranged substantially in parallel to said main production line, said inlet station for selectively feeding articles to be packaged into one of said main production line or said by-pass line, and a single collecting switch forming an outlet station for both of said main production line and for said by-pass line for receiving articles from both lines and for feeding articles from both lines to said packaging station, wherein said article inlet station comprises an article infeed device for supplying articles to said apparatus, said article infeed device being positioned at a first substantially horizontal plane, said transport mechanism comprising a by-pass transport device also positioned at said first substantially horizontal plane in alignment with said infeed device, said single collecting switch also being positioned at said first substantially horizontal plane so that said infeed device, said by-pass transport device, and said collecting switch are all aligned with one another in said first substantially horizontal plane, wherein said main production line is positioned at a second substantially horizontal plane positioned above said first substantially horizontal plane, said transport mechanism further comprising an exit transport device bridging a gap between said main production line and said single collecting switch for feeding articles from said main production line to said single collection switch, and wherein said folding station comprises a first folding device forming part of said by-pass line, a second folding device forming part of said main production line at said second substantially horizontal plane, said folding station further comprising a transfer device bridging a gap between said first and second folding devices.

2. The apparatus of claim 1, further comprising in said main production line additional stations including an article enveloping station, an adhesive applicator, and an embossing and cutting station downstream of said enveloping station as viewed in a feed advance direction from said inlet station to said packaging station.

3. The apparatus of claim 1, wherein said transport mechanism comprises a by-pass conveyor including at least one suction belt, at least one suction box for applying suction through said suction belt for holding articles on said suction belt by suction.

4. The apparatus of claim 1, wherein said collecting switch comprises a drive roller, a suction belt, and a suction box forming a transport mechanism for cooperating with one of the main production line and said by-pass line.

5. The apparatus of claim 1, wherein said transport mechanism comprises at least one belt having an upper run on which articles are supported.

6. The apparatus of claim 1, wherein said transport mechanism comprises conveyors including at least one lower belt and at least one upper belt.

7. The apparatus of claim 1, wherein said transport mechanism comprises a plurality of by-pass conveyor belts arranged in a row one after the other between said article inlet station and said collection switch.

8. The apparatus of claim 1, wherein said bridging transfer device extends substantially vertically between said first and second substantially horizontal planes.

* * * * *